US007415098B2

(12) United States Patent
Leppert

(10) Patent No.: US 7,415,098 B2
(45) Date of Patent: Aug. 19, 2008

(54) COLLIMATOR FOR STRAY RADIATION, IN PARTICULAR FOR MEDICAL X-RAY DEVICES AND METHOD FOR PRODUCING SAID COLLIMATOR

(75) Inventor: Jürgen Leppert, Forchheim (DE)

(73) Assignee: Siemens Aktiengesellschaft, Munich (DE)

( * ) Notice: Subject to any disclaimer, the term of this patent is extended or adjusted under 35 U.S.C. 154(b) by 104 days.

(21) Appl. No.: 10/580,114

(22) PCT Filed: Nov. 11, 2004

(86) PCT No.: PCT/EP2004/052930

§ 371 (c)(1),
(2), (4) Date: May 19, 2006

(87) PCT Pub. No.: WO2005/050669

PCT Pub. Date: Jun. 2, 2005

(65) Prior Publication Data

US 2007/0147587 A1 Jun. 28, 2007

(30) Foreign Application Priority Data

Nov. 21, 2003 (DE) ..... 103 54 811

(51) Int. Cl.
*G21K 1/02* (2006.01)

(52) U.S. Cl. ..... 378/149

(58) Field of Classification Search ..... 378/19, 378/145, 147, 149, 154, 156, 158, 159; 250/505.1
See application file for complete search history.

(56) References Cited

U.S. PATENT DOCUMENTS

| | | | | |
|---|---|---|---|---|
| 5,263,075 | A | 11/1993 | McGann et al. | 378/147 |
| 5,468,970 | A | 11/1995 | Kocsis et al. | |
| 6,031,893 | A | 2/2000 | Schmettow | 378/154 |
| 6,047,044 | A | 4/2000 | Lehmann et al. | 378/154 |
| 6,167,110 | A | 12/2000 | Possin et al. | 378/19 |
| 6,177,237 | B1 | 1/2001 | Guida et al. | |
| 6,324,259 | B1 | 11/2001 | Lehmann et al. | 378/154 |
| 6,327,341 | B1 | 12/2001 | Hoheisel | |
| 6,408,054 | B1 * | 6/2002 | Rahn et al. | 378/154 |
| 6,744,852 | B2 | 6/2004 | Klotz et al. | |
| 2001/0002699 | A1 | 6/2001 | Such et al. | 250/367 |

FOREIGN PATENT DOCUMENTS

| | | |
|---|---|---|
| DE | 197 26 846 C1 | 1/1999 |
| DE | 197 30 755 A1 | 1/1999 |
| DE | 199 20 301 C2 | 8/2001 |
| DE | 101 36 946 A1 | 2/2003 |
| EP | 0 967 619 A2 | 12/1999 |
| WO | WO 99/31 674 A1 | 6/1999 |

* cited by examiner

*Primary Examiner*—Courtney Thomas
(74) *Attorney, Agent, or Firm*—Harness, Dickey & Pierce

(57) ABSTRACT

A collimator is disclosed for stray radiation, in particular for medical X-ray devices. In addition, a method is disclosed for producing the collimator. The collimator includes numerous absorption elements for X-ray radiation which are separated from one another by a filler and support material and are aligned approximately in parallel or oriented towards a common focus. In the collimator, the absorption elements are statistically distributed. A collimator of this type is extremely cost-effective to produce.

17 Claims, 2 Drawing Sheets

COLLIMATOR FOR STRAY RADIATION, IN PARTICULAR FOR MEDICAL X-RAY DEVICES AND METHOD FOR PRODUCING SAID COLLIMATOR

This application is the national phase under 35 U.S.C. § 371 of PCT International Application No. PCT/DE2004/052930 which has an International filing date of Nov. 11, 2004, which designated the United States of America and which claims priority on German Patent Application number 103 54 811.4 filed Nov. 21, 2003, the entire contents of which are hereby incorporated herein by reference.

FIELD

The present invention generally relates to a collimator for stray radiation. For example, it may to a collimator for medical X-ray devices, including numerous absorption elements for X-ray radiation, separated from one another by a filler and support material, which are aligned approximately in parallel or oriented towards a common focus. The invention also generally relates to a method for producing a collimator.

BACKGROUND

In typical fields of application of radioscopy such as, for example, X-ray inspection or medical X-ray diagnostics, the resolution which can be achieved in the radioscopy plays an important role. Good resolution is achieved when detector arrays with detector elements of small area which are as close to one another as possible and a device for closely limiting the wide solid angle at which the X-ray radiation can impinge on the respective detector element, which is arranged in front of these detector elements, are used. In the ideal case, this device, known as collimator, only allows the X-ray radiation propagating on a straight line connection between the focus of the X-ray tube used and the respective detector element to pass and absorbs X-ray radiation which is incident an another angle due to scattering.

Due to its history, the stray radiation does not contribute to the image information and leads to a distinct impairment of the signal/noise ratio and of the achievable resolution of the X-ray image if it impinges on the detector elements with full force. By using suitable collimators which, as a rule, are adapted to the geometric relationships of the respective X-ray system, particularly the arrangement of the X-ray tube and X-ray detectors, the proportion of stray radiation reaching the detector elements can be clearly reduced so that, in many cases, usable X-ray images are only obtained by this.

Collimators include numerous absorption elements for X-ray radiation, which are separated from one another by a filler and support material and are aligned approximately in parallel or oriented towards a common focus, the focus of the X-ray tube. In present-day X-ray CT installations, collimators are still used, as a rule, which have lead strips extending approximately in parallel with one another or aligned towards the X-ray focus, between which paper strips are inserted as filler and support material. In many cases, the distance of the lead strips is adjusted during the production of the collimators in such a manner that the lead strips are located as accurately as possible above the partitions of the fluorescent arrays at the detector end when the collimator is used.

The collimators must, therefore, be produced with great mechanical precision. The alignment onto the focus of the X-ray tube implemented in part also requires an elaborate production process. Due to these high requirements for precision, the production of the collimators causes high costs. A two-dimensional collimation of the X-ray radiation as is required when two-dimensional detector arrays are used cannot be achieved with such collimators, either.

From DE 197 26 846 C1, a collimator is known in which the distance of the absorption elements which are also strip-shaped here and which are aligned in parallel with one another continuously increases from the center of the collimator towards the edge. At the same time, the width of the absorption elements is increased towards the edge. Constructing the collimator in this manner makes it possible to implement an absorption characteristic which is largely uniform over the entire collimator width.

However, the requirements for manufacturing precision are also high in this case.

From DE 199 20 301 C2, a further collimator is known in which the absorption elements extend essentially radially with respect to a center in spaced-apart rows. The variation and the arrangement of the absorption elements are predetermined in accordance with a particular rule in this collimator. The support material used is silicon into which holes are etched in accordance with the required variation of the rows of absorption elements. Into these holes, pin-shaped absorption elements of lead are inserted. This collimator, too, requires that very high precision is maintained during the production which is achieved, in particular, by the proposed manufacturing technique with silicon as support material.

U.S. Pat. No. 5,263,075 A describes a collimator which allows two-dimensional collimation of the incident X-ray radiation. The collimator is produced from a glass fiber bundle from which individual disc-shaped sections are sawn out. The cores of the individual glass fibers are etched out so that capillary passage channels are produced for the X-ray radiation. The glass material is subsequently doped with up to 60% lead in the form of lead oxide so that an increased X-ray absorption is achieved outside the passage channels. Due to the etching and doping steps required in this arrangement, the production of this collimator is also relatively expensive.

SUMMARY

An object of at least one embodiment of the present invention relies in specifying a collimator for stray radiation and/or a method for producing it which provide for inexpensive production.

Advantageous embodiments of the collimator and of the method can be found in the subsequent description and the example embodiments.

At least one embodiment of the collimator for stray radiation includes numerous absorption elements for X-rays which are separated from one another by a filler and support material and which are either aligned approximately in parallel with one another or oriented towards a common focal point. The collimator, in at least one embodiment, is distinguished by the fact that the absorption elements are not arranged in precisely the same distance or in accordance with a particular mathematical rule, but are arranged in a statistically distributed manner.

This provides for a much more inexpensive production of such a collimator since no highly precise alignment of the absorption elements and maintenance of narrow tolerances is required during the production. Due to the statistical distribution of the absorption elements, the use of such a collimator of at least one embodiment does not have a negative influence on the image quality of the X-ray image generated, since no image artifacts caused by periodic structures can occur. When such a collimator of at least one embodiment is used—or even when it is produced—it should be taken into consideration that the width of the absorption elements is less than the width of the detection area of an individual detector element so that no complete coverage of the area of a detector element can occur.

In the context of embodiments of the present invention, a statistical distribution is understood to include randomly varying distances between the absorption elements which occur automatically during the production when the absorption elements are informally distributed over the width of the collimator. Naturally, the individual absorption elements must include a material which is highly absorbent for X-ray radiation, for example of a heavy metal such as lead, tungsten, tantalum or molybdenum. Other materials highly absorbent of X-ray radiation such as, for example, plastics filled with lead powder can also be used as materials for the absorption elements. On the other hand, the filler and support material should absorb the X-ray radiation as little as possible. Examples of such materials are plastics such as polyethylene, polystyrene or polypropylene.

The absorption elements may be bonded with the filler and support material since this is a very simple and cost-effective technique for producing a collimator. For the operation of a collimator having such a structure, a filling percentage of the absorption elements, i.e. the volume percentage of the absorption elements in the total volume of the collimator of 5 to 30% has been found to be advantageous since adequate collimation is achieved with this value without having to accept significant weakening of the X-ray radiation carrying the image information.

The collimator itself can be constructed to be plate-shaped, the absorption elements then being essentially aligned in parallel. Such a collimator produced in the form of a level plate can also be deformed mechanically, however, in such a manner that it forms a plate bent approximately like a calotte shell in which the absorption elements are then aligned at least approximately towards the center of the sphere which should correspond to the focus of the X-ray tube when the collimator is used. Such deformation can be achieved easily especially when plastics are used as filler and support material.

The present collimator of at least one embodiment can be used for all applications in which collimation of the X-ray radiation is required. The preferred field of application, however, resides in using it with medical X-ray devices, particularly in computer tomography. By using rod- or fiber-shaped absorption elements which are aligned perpendicularly to the surface of the collimator—instead of strip or foil-like absorption elements—a two-dimensional statistical distribution, and thus two-dimensional collimation, can also be achieved. As a result, the present collimator of at least one embodiment is also suitable for two-dimensional detector arrays apart from single-row detector arrays. In particular, the collimator can also be used for large-area X-ray detectors.

In an example embodiment, the absorption elements are formed by individual fibers of a material which is highly absorbent for X-ray radiation. In the same manner, fibers of a material which is largely transparent for X-ray radiation are used as filler and support material. Simple mixing and bonding of the two types of fiber then produces a fiber bundle which can be cut or sawn into individual discs perpendicularly to the fiber axis and which form the collimator. The fibers representing the absorption elements preferably have a fiber diameter of =0.2 mm, preferably within the range of between 10 μm and 200 μm so that they are thinner than the width of the conventional detector elements in every case.

The method for producing the collimator according to at least one embodiment of the invention is mainly distinguished by the fact that the absorption elements are bonded with the filler and support material to form a collimator in such a manner that a statistical distribution of the absorption elements over the width of the collimator is obtained.

When used, the collimator of at least one embodiment is only placed on the detector array or mounted above it without having to take into consideration a correlation with the individual detector elements or pixels of the detector array. Thus, there is no positioning effort in this case, either.

BRIEF DESCRIPTION OF THE DRAWINGS

The collimator and the associated method for producing it will be explained again by way of example in the text which follows with reference to example embodiments in conjunction with the figures, in which.

DETAILED DESCRIPTION OF THE EXAMPLE EMBODIMENTS

Figure 1:
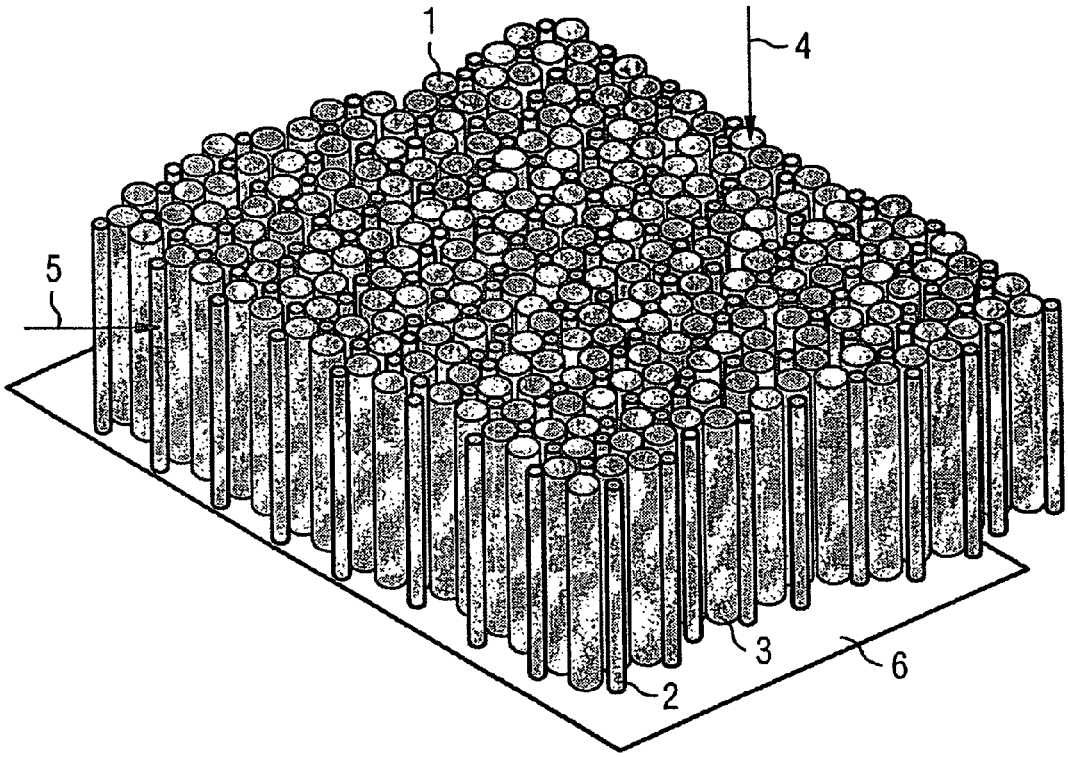
FIG. 1 shows an example embodiment of the configuration of the present collimator with individual fibers.

FIG. 1 shows an example embodiment of the configuration of the present collimator 1 which corresponds to a section above an individual pixel of approx. 1 $mm^2$ size, i.e. the detection area 6 of an example detector element. In this arrangement, the individual absorption elements are formed of metal fibers 2 of a heavy metal, which are aligned in parallel with one another and which are embedded between plastic fibers 3 as filler and support material. In the figure, the statistical distribution of the metal fibers 2 within the area of the collimator 1 shown can be seen. The plastic fibers 3 are constructed to be essentially transparent for the incident X-ray radiation whereas the metal fibers 2 are highly absorbent for this X-ray radiation. An X-ray quantum 4 impinging perpendicularly to the surface of the collimator 1 and carrying the desired image information penetrates the plastic fibers 3 almost with full force and impinges on the detector or fluorescent pixel located underneath so that it is detected by the detector element. By comparison, an obliquely incident stray radiation quantum 5 will encounter a number of highly absorbent metal fibers 2 on its way to the detector so that it will be absorbed.

Due to the unstructured arrangement of the absorbent metal fibers 2 as absorption elements within the collimator 1, no precise positioning of the collimator 1 above the individual pixels of a detector array is required. The unstructured arrangement of the fibers 2 provides for very inexpensive production of such a collimator as is explained by way of example in the FIG. 2 following.

Figure 2A:
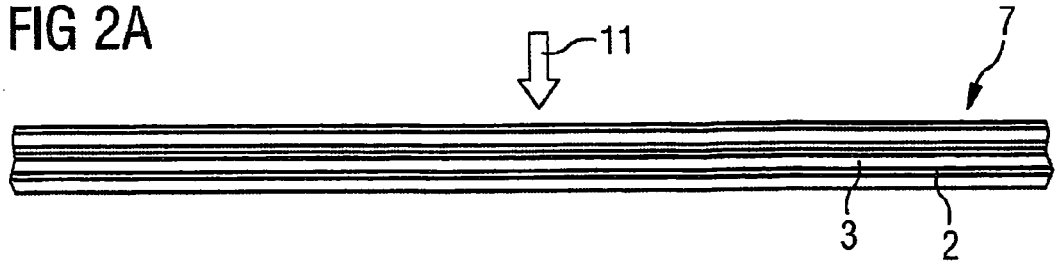
FIG. 2 shows an example embodiment of individual production steps for producing the present collimator.

For the production of a collimator like that of FIG. 1, fibers 3 of a material having a lower X-ray absorption, for example polymer fibers of polyethylene, polystyrene or polypropylene, and metal fibers 2 or fibers of other materials with high X-ray absorption are provided. The fibers 2, 3 are intermixed in a predeterminable mixing ratio, in particular with a filling percentage of the highly absorbent fibers 2 of preferably between 5 and 30% and provided as fiber stack 7 as can be seen in FIG. 2*a*. The fiber stack 7 is impregnated with adhesive 11 in order to bond the fibers to form a fiber compound 8.

Mixing the fibers 2, 3 results in a statistical distribution of the highly absorbent fibers 2 within the fiber stack 7.

Figure 2B:
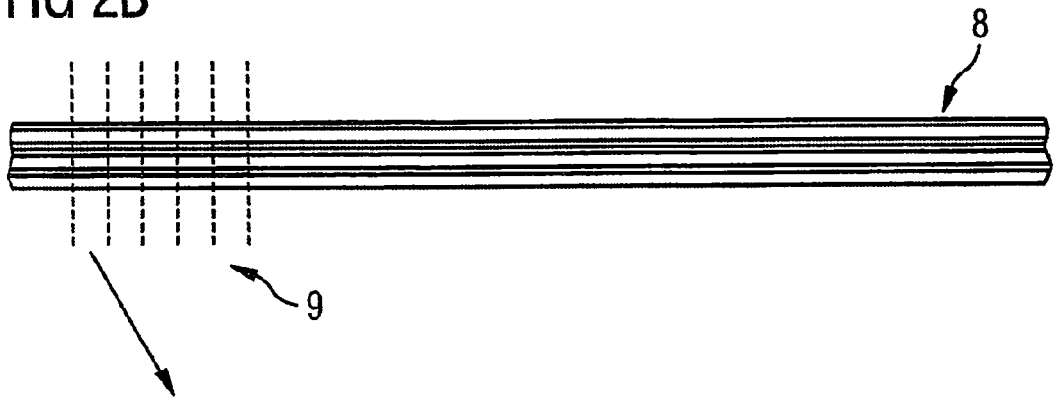
Figure 2C:
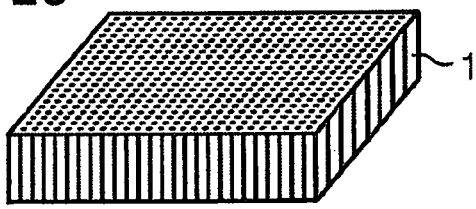

After the compound fiber system 8 has been produced, it is split into individual discs perpendicular to the direction of the fibers, forming the collimator 1. FIG. 2*b* shows the sawing cuts 9 and FIG. 2*c* shows the collimator 1 produced by one of the sawn discs as compound fiber system. In this manner, a collimator for two-dimensional collimation has been produced which exhibits a statistical distribution of the absorption elements 2 over the width of the collimator as can be seen in section in FIG. 1.

Figure 3:
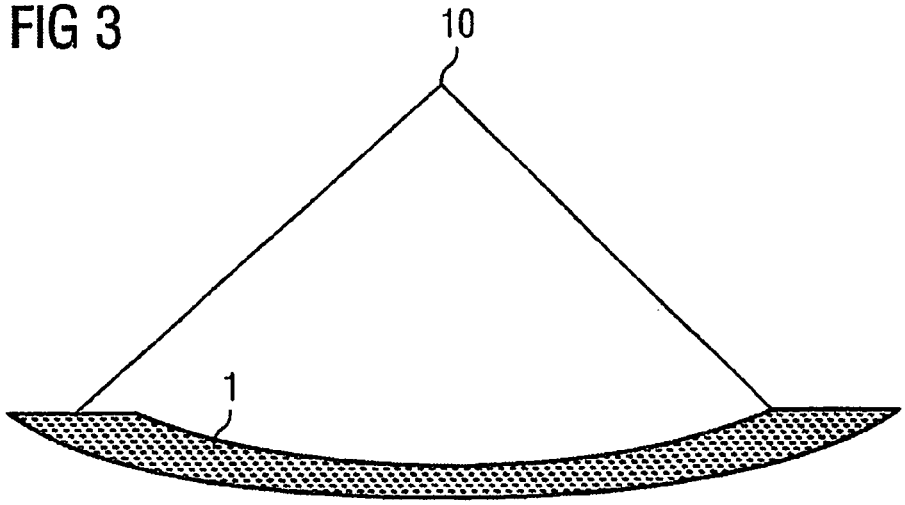
FIG. 3 shows an example embodiment of a collimator which is constructed in the form of a plate bent in the form of a calotte shell.

Apart from the collimator formed in this manner in the form of a level plate, collimators in the form of a plate formed approximately like a calotte shell can be produced as is shown diagrammatically in FIG. 3. Such a collimator 1 is obtained by deforming the collimator of FIG. 2 with the aid of mechanical devices. Thus, the collimation, i.e. the alignment of the absorption elements to the X-ray focus 10 of the respective X-ray installation can be achieved by suitable deformation.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A collimator for stray radiation, comprising:

a plurality of absorption elements to absorb X-ray radiation, separated from one another by a filler and support material, the plurality of absorption elements being at least one of aligned approximately in parallel and oriented towards a common focus, and the plurality of absorption elements being arranged in a statistically distributed manner, wherein the filler and support material are formed by individual fibers of a material which is transparent to X-ray radiation.

2. The collimator as claimed in claim 1, wherein the absorption elements include individual fibers of a material which is absorbent for X-ray radiation.

3. The collimator as claimed in claim 2, wherein the fibers of the material which is absorbent for X-ray radiation, include a fiber diameter of 0.2 mm.

4. The collimator as claimed in claim 2, wherein the fibers of the material which is absorbent for X-ray radiation and the fibers of the material which is transparent to X-ray radiation are at least one of aligned approximately in parallel with one another and oriented towards the common focus.

5. The collimator as claimed in claim 1, wherein the absorption elements and the filler and support material are bonded to one another.

6. The collimator as claimed in claim 1, wherein the absorption elements and the filler and support material are present in the collimator in a volume ratio which results in a filling percentage of between 5% and 30% with the absorption elements.

7. The collimator as claimed in claim 1, wherein the absorption elements are formed of a metallic material and the filler and support material is a plastic material.

8. The collimator as claimed in claim 1, wherein the collimator is constructed in the form of a level plate in which the absorption elements are aligned at least approximately perpendicularly to a plate plane.

9. The collimator as claimed in claim 1, wherein the collimator is constructed in the form of a plate which is bent approximately in the form of a calotte shell and in which the absorption elements are aligned towards a center of the sphere.

10. A medical X-ray device comprising the collimator of claim 1.

11. A method for producing a collimator including a plurality of absorption elements to absorb X-ray radiation and a material to separate the plurality of absorption elements, the method comprising:

bonding the absorption elements to the material to form a collimator in such a manner that a statistical distribution of the absorption elements over a width of the collimator is obtained, wherein fibers of a material which is absorbent for X-ray radiation as absorption elements are intermixed with fibers of a material which is transparent to X-ray radiation as the material, from the intermixed fibers a fiber stack is formed and bonded to form a compound fiber system and the compound fiber system is split into individual discs perpendicularly to the fiber axes of the intermixed fibers.

12. The method as claimed in claim 11, wherein the fibers of the material which is absorbent for X-ray radiation and the fibers of the material transparent to X-ray radiation are intermixed in a ratio which results in a filling percentage of between 5% and 30% with the fibers of the material which is absorbent for X-ray radiation.

13. The method as claimed in claim 11, wherein the absorption elements and the material are bonded to one another.

14. A collimator for stray radiation, comprising:

a plurality of absorption elements to absorb X-ray radiation; and a material to separate the plurality of absorption elements, the plurality of absorption elements being arranged in a statistically distributed manner, wherein the material is formed by individual fibers of a material which is transparent to X-ray radiation.

15. A medical X-ray device comprising the collimator of claim 14.

16. The collimator as claimed in claim 14, wherein the absorption elements include individual fibers of a material which is absorbent for X-ray radiation.

17. The collimator as claimed in claim 16, wherein the fibers of the material which is absorbent for X-ray radiation, include a fiber diameter of 0.2 mm.

* * * * *